United States Patent [19]

Klimek et al.

[11] 4,247,207

[45] Jan. 27, 1981

[54] MATRIX PRINTER

[75] Inventors: Norbert M. Klimek, Cockfosters; Manfred A. Huber, New Barnet, both of England

[73] Assignee: The Rank Organisation Limited, London, England

[21] Appl. No.: 2,177

[22] Filed: Jan. 9, 1979

[30] Foreign Application Priority Data

Jan. 9, 1978 [GB] United Kingdom ..... 637

[51] Int. Cl.³ ..... B41J 3/12

[52] U.S. Cl. ..... 400/121; 101/93.04; 400/119

[58] Field of Search ..... 400/119, 124, 121; 346/153, 155, 162–164; 101/93.04, 93.05

[56] References Cited

U.S. PATENT DOCUMENTS

| | | | |
|---|---|---|---|
| 3,627,096 | 12/1971 | Finnegan | 178/30 X |
| 3,826,915 | 7/1974 | Giolitti et al. | 400/119 X |
| 3,991,868 | 11/1976 | Robinson et al. | 400/124 |
| 4,033,444 | 7/1977 | Beery | 400/124 |
| 4,037,705 | 7/1977 | Martin et al. | 400/124 |

*Primary Examiner*—Paul T. Sewell

*Attorney, Agent, or Firm*—Brisebois & Kruger

[57] ABSTRACT

An electrostatic matrix printer has a movable print head (1) in which a row of selectively energizable needles (2) is fixed for printing dots on a surface to be printed by selective energization of the needles in response to binary coded electrical signals having a number of bits, equal or less than the number of needles in the row. The binary signals, as well as determining the state of a group of consecutive needles in the row, to print different character columns, also include at least one further bit which determines the position of the said selected group of needles in the row, enabling characters of different height and vertical position to be printed.

1 Claim, 5 Drawing Figures

Fig.4.

| $2^7$ | $2^6$ | $2^5$ | $2^4$ | $2^3$ | $2^2$ | $2^1$ | $2^0$ | COL / ROW | 0 | 1 | 2 | 3 | 4 | 5 | 6 | 7 | 8 | 9 | 10 (A) | 11 (B) | 12 (C) | 13 (D) | 14 (E) | 15 (F) |
|---|---|---|---|---|---|---|---|---|---|---|---|---|---|---|---|---|---|---|---|---|---|---|---|---|
| | | | | | | | | | 0 | 0 | 0 | 0 | 0 | 0 | 0 | 0 | 1 | 1 | 1 | 1 | 1 | 1 | 1 | 1 |
| | | | | | | | | | 0 | 0 | 0 | 0 | 1 | 1 | 1 | 1 | 0 | 0 | 0 | 0 | 1 | 1 | 1 | 1 |
| | | | | | | | | | 0 | 0 | 1 | 1 | 0 | 0 | 1 | 1 | 0 | 0 | 1 | 1 | 0 | 0 | 1 | 1 |
| | | | | | | | | | 0 | 1 | 0 | 1 | 0 | 1 | 0 | 1 | 0 | 1 | 0 | 1 | 0 | 1 | 0 | 1 |
| | | | | 0 | 0 | 0 | 0 | 0 | RES | | SP | 0 | § | P | ` | p | | | | | | | | |
| | | | | 0 | 0 | 0 | 1 | 1 | | | ! | 1 | A | Q | a | q | | | | | | | | |
| | | | | 0 | 0 | 1 | 0 | 2 | | | " | 2 | B | R | b | r | | | | | | | | |
| | | | | 0 | 0 | 1 | 1 | 3 | | | £ | 3 | C | S | c | s | | | | | | | | |
| | | | | 0 | 1 | 0 | 0 | 4 | | | $ | 4 | D | T | d | t | | | | | | | | |
| | | | | 0 | 1 | 0 | 1 | 5 | | | % | 5 | E | U | e | u | | | | | | | | |
| | | | | 0 | 1 | 1 | 0 | 6 | | | & | 6 | F | V | f | v | | | | | | | | |
| | | | | 0 | 1 | 1 | 1 | 7 | | | | 7 | G | W | g | w | | | | | | | | |
| | | | | 1 | 0 | 0 | 0 | 8 | BAS | | ( | 8 | H | X | h | x | | | | | | | | |
| | | | | 1 | 0 | 0 | 1 | 9 | | | ) | 9 | I | Y | i | y | | | | | | | | |
| | | | | 1 | 0 | 1 | 0 | 10(A) | LSH | | * | : | J | Z | j | z | | | | | | | | |
| | | | | 1 | 0 | 1 | 1 | 11(B) | | | + | ; | K | [ | k | { | | | | | | | | |
| | | | | 1 | 1 | 0 | 0 | 12(C) | PLT | | , | < | L | \ | l | \| | | | | | | | | |
| | | | | 1 | 1 | 0 | 1 | 13(D) | | | — | = | M | ] | m | } | | | | | | | | |
| | | | | 1 | 1 | 1 | 0 | 14(E) | | | . | > | N | ↑ | n | ‾ | | | | | | | | |
| | | | | 1 | 1 | 1 | 1 | 15(F) | | | / | ? | O | _ | o | DEL | | | | | | | | |

BIT 8 = 1 DENOTES DOUBLE WIDTH CHARACTERS

MATRIX PRINTER

This invention relates to a matrix printer, and in particular to a matrix printer capable of printing selected alpha-numeric characters, alternatively of printing graphic plots, each character or plot being built up from printed dots.

An object of the present invention is to provide a matrix printer in which the printing of a row of dots on a surface is controlled by a binary coded signal. By printing a succession of rows in parallel spaced apart columns it is possible to build up individual alphanumeric characters, or to build up a graphic plot on the surface, by suitably predetermining the dots printed in each successive row.

According to the present invention there is provided a matrix printer comprising a print head having a row of selectively energisable needles adapted to cooperate with a surface to be printed, means for energising the needles selectively to cause the printing of dots on the surface in response to a binary coded electrical signal having a number of bits, equal to or less than the number of needles in the row, determining the state of a group of consecutive needles in the row, and at least one further bit which determines the position of the said selected group of needles in the row. By using one of the bits of the binary coded signal to determine the position of the group of energised needles relative to the row of needles it is possible to predetermine the position of a printed character relative to the opposite ends of the row of needles.

For printing an alpha-numeric character a succession of prints would be made by the row of needles in a number of adjacent parallel columns spaced apart on the surface to be printed, each column being printed by the head with dots in positions determined by the respective binary coded electrical signals, which in this mode of operation are referred to as character column codes. A typical character format would be a $7\times5$ matrix made up of five vertical columns each of which is seven spaces high, dots being printed in the respective spaces according to the character column code for each respective column of the character to be formed. The use of a character matrix which is seven spaces high conveniently allows a character column code of eight-bit binary words to be employed, seven consecutive bits of the word being utilised for the selective energisation of needles in the head to form the character column, and the remaining bit being utilised to determine the position relative to the row of needles of the printed character column. Thus the head may be provided with nine needles arranged in a row so as to print a vertical column of a character, the upper seven needles of the row forming the group of printing needles when printing a character which is to be aligned with the upper edge of the row, and the lower seven group of needles forming the printing group when the resulting character is to be aligned with the bottom end of the row. By shifting selectively the group of printing needles in the printing head along the row of needles, to one or the other end of the row, the printer can be arranged to print a variety of characters, both upper and lower case, with good character resolution.

The set of character column codes corresponding to each alpha-numeric character to be printed are preferably stored in a programme memory which can be selectively addressed by binary codes, preferably in ASCII code, corresponding to each different character to be printed, contained in a buffer store, the means for selectively energising the needles being responsive to the appropriate character column codes extracted from the programme memory when the latter is addressed by a binary code corresponding to a selected character to be printed.

The binary codes stored in the buffer store are preferably eight-bit words corresponding to different characters, each character being stored in single width sizes only. The most significant bit of the respective address word determining whether or not the image is single wide or double wide on paper.

The printer preferably includes means for advancing the head parallel to the surface to be printed in a direction perpendicular to the direction of the row of needles, and means for energising the needles selectively at regular intervals during the advance of the head to cause the printing of successive parallel columns of dots as the head advances. Various electro-mechanical means may be provided for advancing the head and energising the selected needles at regular intervals related to the rate of advance of the head to print successive columns at a predetermined pitch spacing. Such means do not form part of the present invention, which is concerned essentially with the print head and its control signals. A photoelectric means of controlling the periodic energisation of the print head is described in a copending Patent Application.

Although the invention is applicable to matrix printers in which dots or holes are printed or punched mechanically on a surface, the invention is particularly applicable to a matrix printer in which printing is effected non-mechanically by electrical energisation of needles which cooperate with an electro-sensitive printing surface. Such an electro-sensitive matrix printer would have needles fixed in the head and arranged to be energised by the selective application thereto of a potential relative to the potential of the surface to be printed such as to result in a mark on the surface, by purely electrical, non-mechanical action. Since such a printer does not rely upon mechanical impact with the surface to be printed the printer is silent in operation and has relatively long-wearing parts. Moreover, the printer, by cooperating with an electro-sensitive printing surface, does not use a printing ribbon or printing ink.

A matrix printer according to one embodiment of the invention will now be described, by way of example, with reference to the accompanying purely schematic drawings, in which:

FIG. 4 is a table illustrating the binary codes assigned to the characters illustrated in FIGS. 2 and 3.

Figure 1:
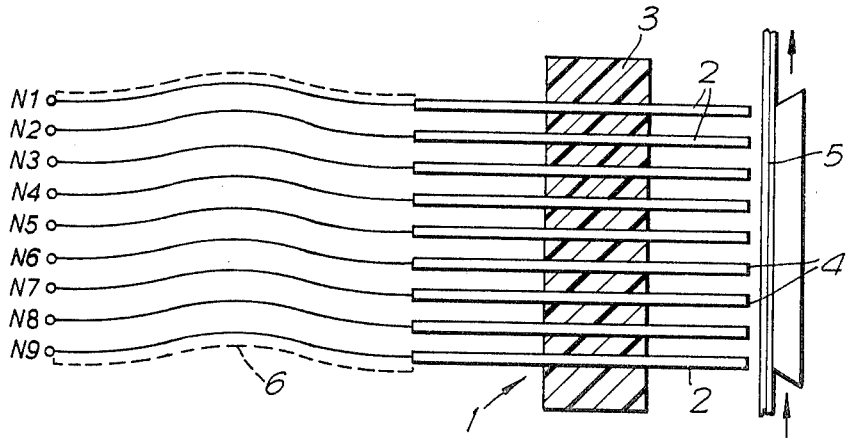
FIG. 1 illustrates diagrammatically a print head of an electro-sensitive matrix printer according to the invention.

The illustrated matrix printer according to the invention has a needle head 1 formed by nine identical cylindrical needles 2 of molybdenum or tungsten embedded in an epoxy resin block 3, the needles being arranged parallel to each other in a row with flat printing end faces 4 arranged coplanar to each other and parallel to the surface of an electrosensitive laminated web 5 to be printed. In a typical practical example the needles 2 would have a diameter of 0.25 mm and a pitch spacing of 0.45 mm.

The electro-sensitive laminated web 5 is made up of a three-layer sandwich comprising a base layer of ordinary paper, a central layer of carbon and an upper layer comprising a thinly evaporated aluminium film. The laminated web has the same handling texture as ordinary paper, but is mechanically much stronger than paper. Selected areas of the aluminium film may be evaporated by the application of an electric discharge. In the arrangement of the present invention the electro-sensitive web 5 is earthed by means of a suitable contact roller (not shown) and printing is effected by applying to any selected needle or needles 2 of the head 1 a potential of 30 volts, this being sufficient to cause local evaporation of the aluminium film immediately beneath the printing face 4 of each energised needle, exposing the underlying carbon layer and resulting in the effective printing of a circular dot on the web, in this case with a diameter of 0.40 mm. The energising potential of 30 volts is within the internationally recognised safety limits, being regarded as safe for contact with the human body.

The print head 1 is mounted in a movable carriage (not shown) which is driven by a belt or other suitable drive mechanism so as to make "line scan" movements in a direction perpendicular to the row of needles 2, parallel to the surface of the web 5 to be printed. Electrical connections to the individual needles 2 of the print head 1 are made to the ends of the needles 2 opposite the end faces 4 by means of individual conductive strips printed on a flexible connector ribbon 6 which connects the movable head 1 to nine respective needle output terminals N1–N9 of a printing control unit, illustrated schematically in FIG. 5.

Light contact pressure is maintained between the surface of the web 5 and the end faces 4 of the needles 2 by passing the web 5 over a flat rubber-coated platen bar which maintains the aluminium-coated surface of the web in light contact with the faces 4 of the needles 2. The web 5 is advanced over the platen bar in a direction perpendicular to the scanning movement of the head 1, to effect vertical or line shifts between the scanning of successive lines by the head 1. Precision movement of the web 5 is effected by a sprocket wheel drive or more conventionally by means of friction roller drive.

Separate d.c. electric motors with skew windings and iron-less rotors having low moment of inertia are used to provide the drive for the print head and the web feed sprocket, controlling line scanning and line shift movements respectively.

The nine-needle print head 1 is used to print characters made up of dots. The row of needles 2 prints a vertical column of dots, each character of normal width being made up of five such columns, while characters of double width are made up of ten such columns. Each character column is formed by the selective energisation of the needles 2 in the head 1 by energising signals which are conveniently in eight-bit binary coded form. Each character column code causes energisation of one or more selected needles in a group of seven needles, this group comprising the upper seven needles of the row of nine needles for the printing of characters aligned with the upper edge of the row of needles, while the group consists of the lower seven needles when printing a character which is to be aligned with the lower end of the row of needles. Seven bits of each binary character column code determine the selective energisation of each group of seven needles, while the eighth bit, most significant ($2^7$), is used to determine the positioning of the group of seven needles relative to the row of needles, that is, whether the group is formed by the upper seven needles or the lower seven needles.

The set of nine needles therefore prints characters made up of columns each of which has a maximum of seven dots, the composition of each character column being determined by the binary character column code which determines the energisation of the needles, and which also determines whether the character column in question is aligned with the top or the bottom of a nine-bit high character matrix.

Figure 2:
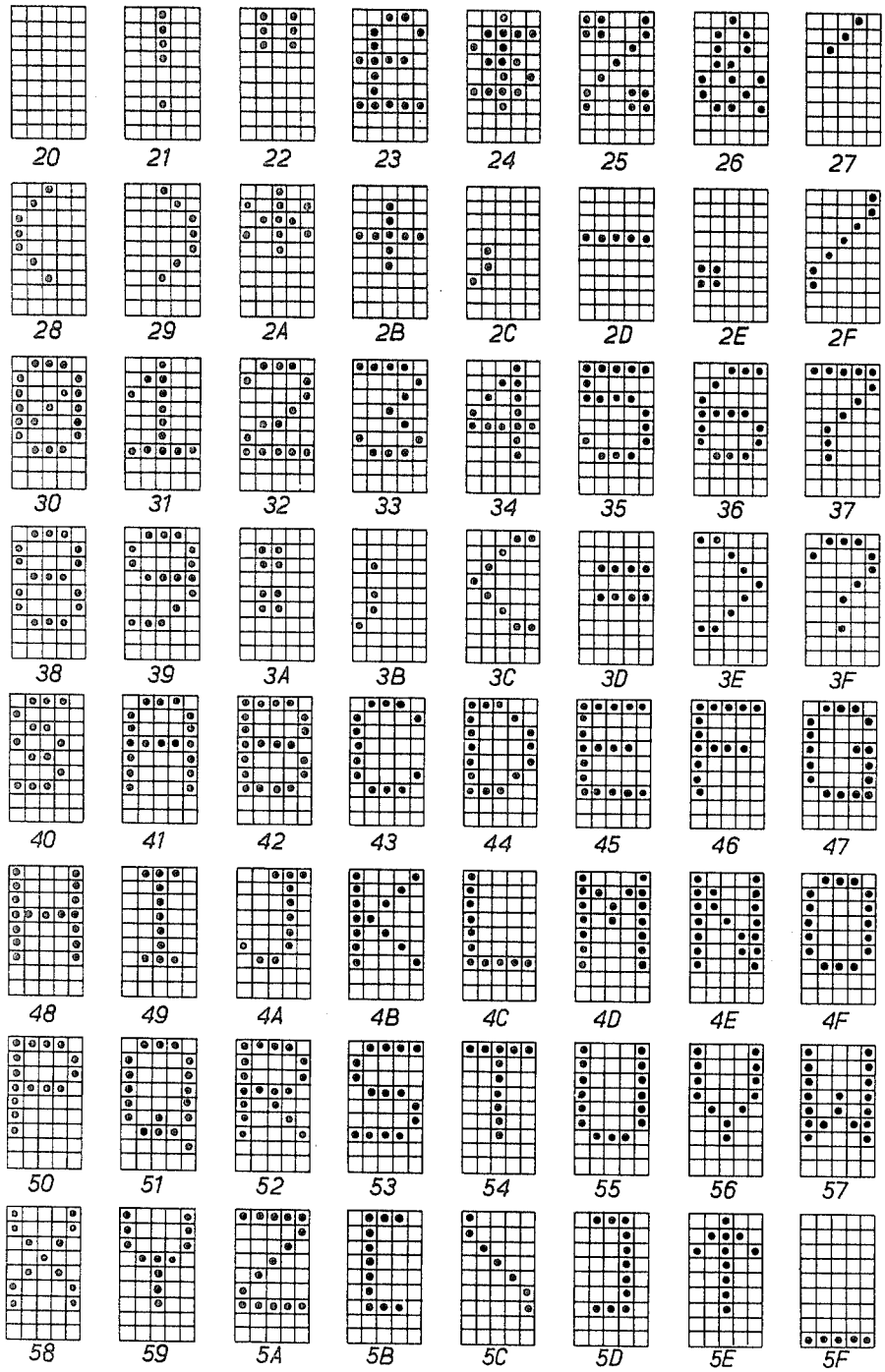
FIGS. 2 and 3 show the dot matrix compositions of characters to be printed by means of the electro-sensitive matrix printer of the invention.
Figure 3:
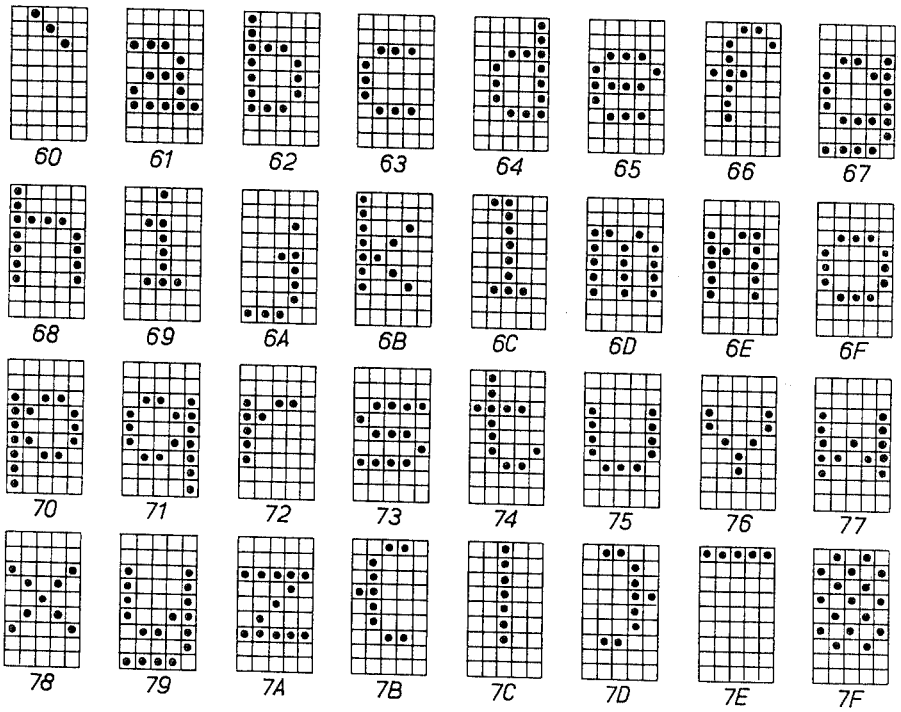

FIGS. 2 and 3 illustrate diagrammatically the composition of alpha-numeric characters, each character being made up of five vertical columns each having a maximum height of seven dots, formed within a matrix which is nine bits high. All the characters indicated in FIGS. 2 and 3 are aligned with the top of the character matrix, with the exception of the codes labelled 5F, 67, 6A, 70, 71 and 79, which are aligned with the bottom of the matrix and which, therefore, are shifted by two bits vertically downwardly relative to the other character codes. The vertical shifting of the columns making up these characters is determined by the eighth bit in each respective character column code.

The character column codes corresponding to each alpha-numeric character of FIGS. 2 and 3 are stored in a programme memory in the form of a look-up table, the dot composition of each character column being determined by the bits 0–6 (binary 0 representing absence of a dot and binary 1 representing a dot), while the eighth bit is zero for all characters which are aligned with the upper edge of the character matrix and set to 1 for all characters which are aligned with the bottom edge of the matrix.

The character column codes corresponding to each alpha-numeric character can be called up by binary addresses provided by a buffer store, which stores a separate binary address in ASCII code for each different alpha-numeric character, as shown in FIG. 4. The address of each character is represented by an eight bit binary coded address, the eighth bit of which represents the width of the character, being zero for characters of normal width and 1 for characters of double width.

Figure 5:
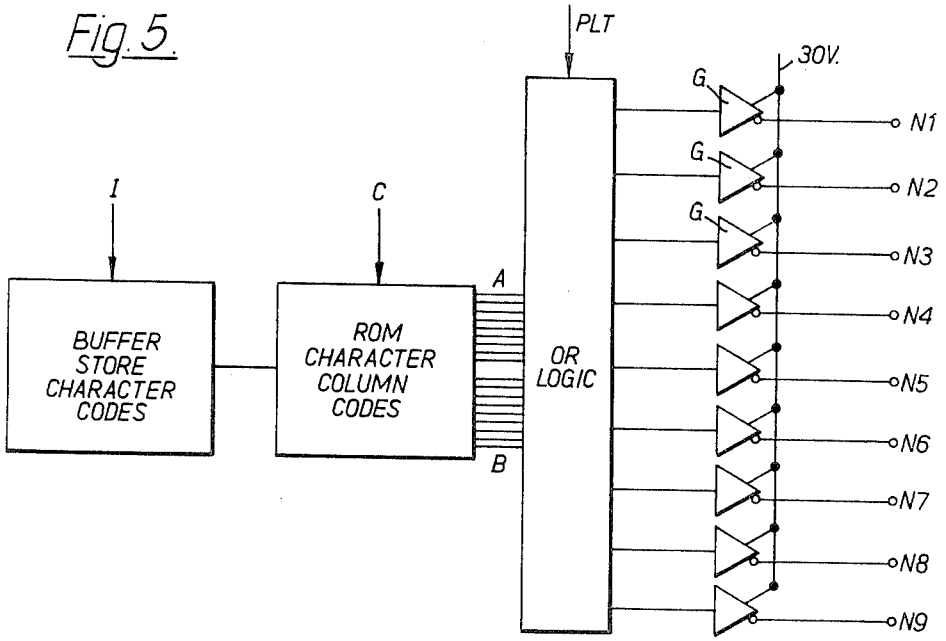
FIG. 5 is a schematic diagram illustrating the electronic control system associated with a matrix printer according to the illustrated embodiment of the invention.

FIG. 5 illustrates purely schematically an arrangement for controlling the selective energisation of the needles 2 in the print head 1 for printing alpha-numeric characters. Instructions I to print a given character are received from a local keyboard or through a line or radio link from a remote station. The appropriate character code is extracted from the buffer store and presented to the programme memory (ROM) associated with a programmable interface adaptor (PIA) after identifying the eighth bit to select printing of a character of single or double width. A set of character column codes will correspond to each character code extracted from the buffer store, and the character code representing the first column is channelled through output ports A or B of the programmable interface adaptor according to whether the eighth bit of the character column code represent upper or lower alignment of the respective character. The output of the programmable interface adaptor passes through OR logic and is utilised to control electronic gates G by means of which a 30 volt energising potential is selectively applied to the respective output terminals N1–N9 connected to the respective needles 2 of the print head. The energising outputs are applied to the selected gates G for a short time interval determined by the length of an interrupt pulse C applied to the programmable interface adaptor and derive from the line scanning movement of the print head 1. The signals C would typically have a duration of 30 microseconds, ensuring that the selected gates G are opened for this time interval when energised by a signal corresponding to a bit of value 1 in the respective character column code. This results in the application of the 30 volt potential to the associated needle N1–N9 for a period of 30 microseconds, printing a dot at the selected position on the web 5.

The 30 microsecond control signals are preferably derived from photocells which are illuminated intermittently by a rotary disc having clear and dark segments rigidly coupled to the drive shaft of the carriage on which the print head 1 is mounted, so as to provide pulses at regular intervals which correspond to the pitch spacing of the characters to be printed, in a manner described in a copending Patent Application. Character columns which compose a given character are therefore printed in succession with a pitch spacing determined by the rate of advance of the print head 1 and the frequency of the control signals C. Typically, where the dots composing each character column have a diameter of 0.40 mm the pitch interval between successive character columns would be 0.42 mm, and the pitch interval between successive single width characters would be six times this interval.

To print slanted or italic style characters the print head would be mounted so that the row of needles 2 is inclined to the vertical, for example at an angle of 12°.

The matrix printer can be used both for the printing of alpha-numeric characters as described, and for the plotting of graphic designs. When used in the plotting mode the character generating means would be bypassed and binary signals representing dot formations to be printed at successive positions of the print head 1 would be fed to the gates G through the OR logic. In this plotting mode eight, rather than seven, adjacent needles would be energised selectively, so that no gap is formed between successive line scans. In this mode of operation the row of needles 2 in the head would be mounted vertically, that is, in a plane perpendicular to the direction of advance of the print head 1.

What is claimed is:

1. A matrix printer for printing characters each based upon a five-column, seven-row dot matrix, said printer comprising a print head having a row of selectively energisable needles adapted to cooperate with the surface to be printed, the number of said needles being greater than seven and said row extending in the direction of a dot column of said character dot matrix, needle-energisation means responsive to an eight-bit column code electrical signal fed thereto to energise the said needles selectively whereby to cause the printing of one or more dots in correspondence to a said column of said character matrix, seven bits of said eight-bit column code determining the state of energisation of respective ones of a group of seven of said needles and the eighth bit determining the position of the said group of seven needles in the row of needles whereby characters having elements descendant below the notional base line of a line of print can be printed in a position shifted down said surface as compared to characters without such descending elements, and column-code generating means including permanent memory means storing for each character printable by the printer, five said eight-bit column codes each corresponding to a respective column of that character, the column-code generating means being responsive to a binary character code fed thereto to successively output the corresponding five eight-bit column codes to the said needle-energisation means.

* * * * *